US006036304A

United States Patent [19]

Emanuel

[11] Patent Number: 6,036,304

[45] Date of Patent: Mar. 14, 2000

[54] INK DELIVERY SYSTEM FLUSHING DEVICE AND METHOD

[75] Inventor: Jeffrey V Emanuel, Vancouver, Wash.

[73] Assignee: Hewlett-Packard, Palo Alto, Calif.

[21] Appl. No.: 08/996,012

[22] Filed: Dec. 22, 1997

[51] Int. Cl.[7] ..... B41J 2/17; B41J 2/175

[52] U.S. Cl. ..... 347/84; 347/86

[58] Field of Search ..... 347/84, 28, 85, 347/86, 87, 89, 30, 29; 137/907, 526, 511

[56] References Cited

U.S. PATENT DOCUMENTS

| | | | |
|---|---|---|---|
| 4,586,058 | 4/1986 | Yamazaki et al. | 347/30 |
| 5,691,753 | 11/1997 | Hilton | 347/85 |
| 5,825,380 | 10/1998 | Ichizawa et al. | 347/28 |

OTHER PUBLICATIONS

Hewlett–Packard Company Patent Application "Replaceable Cartridge, Kit And Method For Flushing Ink From An Inkjet Printer"; S/N 08/785,579; Filed Jan. 21, 1997.

*Primary Examiner*—N. Le
*Assistant Examiner*—Thinh Nguyen
*Attorney, Agent, or Firm*—Erik A. Anderson

[57] ABSTRACT

A kit and method for flushing an ink delivery system of an inkjet printing device so that different printing composition may be used in the printing device are disclosed. An embodiment of the kit includes a fluid module, a coupler, and a vacuum source. The fluid module stores a quantity of fluid for flushing the ink delivery system. The coupler is fluidly connectable to the fluid module and configured to be fluidly and removeably coupled to a first end of the ink delivery system. The vacuum source is configured to be fluidly and removeably coupled to a second end of the ink delivery system, and further configured to be manually actuable to create a vacuum that draws the fluid from the fluid module into the ink delivery system thereby flushing the ink delivery system. An embodiment of the method includes the steps of fluidly and removeably coupling a fluid module to a first end of the ink delivery system of the printing device and fluidly and removeably coupling a vacuum source to a second end of the ink delivery system of the printing device. The method additionally includes the step of manually drawing a vacuum at the second end of the ink delivery system of the printing device thereby drawing fluid out of the fluid module and into the first end of the ink delivery system, and further thereby drawing ink and the fluid out of the second end of the ink delivery system.

17 Claims, 4 Drawing Sheets

INK DELIVERY SYSTEM FLUSHING DEVICE AND METHOD

BACKGROUND AND SUMMARY

The present invention relates to printing devices. More particularly, the present invention relates to a device and a method for flushing an ink delivery system of an inkjet printing device so that different printing composition may be used in the printing device.

Often during printing, it is desirable to change to a different type of ink for a particular printing application. For example, a user may want to switch one or more colors of ink. For inkjet printers that include print cartridges and replaceable ink supply cartridges that supply ink to the print cartridges by an ink delivery system, this cannot simply be done by removing one of the replaceable ink supply cartridges and replacing it with a different color replaceable ink supply cartridge. One reason is that the replacement supply cartridge can become contaminated with ink remaining in the ink delivery system from the previous replaceable ink supply cartridge. In addition, ink from the previous replaceable ink supply cartridge remaining in the ink delivery system will first be printed on a sheet of print media before the different ink from the new replaceable ink supply cartridge, causing the printing device to improperly print the desired text and/or image. Further, a new print cartridge for the different ink can be contaminated by the previous ink remaining in the ink delivery system. A device and method for flushing the ink delivery system is therefore desirable to achieve optimal performance of the printing device when changing one or more of the inks used by the printing device. The present invention is directed at providing such a device and method.

An embodiment of a kit for flushing printing composition from an ink delivery system of a printing device in accordance with the present invention includes a fluid module, a coupler, and a vacuum source. The fluid module is configured to store a quantity of fluid, such as de-ionized water, for flushing the ink delivery system. The coupler is fluidly connectable to the fluid module and configured to be fluidly and removeably coupled to a first end of the ink delivery system. The vacuum source is configured to be fluidly and removeably coupled to a second end of the ink delivery system, and further configured to be manually actuable to create a vacuum that draws the fluid from the fluid module into the ink delivery system, thereby flushing the ink delivery system.

The above-described embodiment of the kit of the present invention may be modified and include the following characteristics as discussed below. The coupler may include a disconnect fitting configured to be fluidly and removeably coupled to the first end of the ink delivery system. The vacuum source may include a syringe. The fluid module may include a replaceable ink supply cartridge filled with fluid for flushing the ink delivery system.

The kit may additionally include a replaceable ink supply container having a first coupler configured to be fluidly and removeably coupled to the first end of the ink delivery system and a second coupler configured to be fluidly and removeably coupled to the fluid module. The kit may be used in a printing device.

An alternative embodiment of a kit in accordance with the present invention includes structure for storing a quantity of fluid used to flush an ink delivery system. The kit also includes structure for fluidly and removeably coupling the structure for storing to a first end of the ink delivery system.

The kit further includes structure configured to be fluidly and removeably coupled to a second end of the ink delivery system for manually drawing a vacuum at the second end of the ink delivery system to cause the fluid in the structure for storing to travel through the ink delivery system and exit the ink delivery system thereby flushing the ink delivery system.

The above-described alternative embodiment of the kit of the present invention may be modified and include the following characteristics as discussed below. The structure for storing may include either a fluid module or a replaceable ink supply container filled with fluid used to flush the ink delivery system. The structure for fluidly connecting may include a disconnect fitting configured to be fluidly and removeably coupled to the first end of the ink delivery system.

The structure for manually drawing a vacuum may include a syringe. The kit may be used in a printing device.

A printing device adapted for switching inks used in an ink delivery system of the printing device in accordance with the present invention includes an ink delivery system, a printing mechanism, a fluid module, a coupler, and a vacuum source. The printing mechanism is coupled to the ink delivery system for printing an image. The fluid module is configured to store a quantity of fluid for flushing the ink delivery system. The coupler is fluidly connectable to the fluid module and configured to be fluidly and removeably coupled to a first end of the ink delivery system. The vacuum source is configured to be fluidly and removeably coupled to a second end of the ink delivery system, and further configured to be manually actuable to create a vacuum that draws the fluid from the fluid module into the ink delivery system thereby flushing the ink delivery system.

The above-described embodiment of the printing device of the present invention may be modified and include the following characteristics as discussed below. The coupler may include a disconnect fitting configured to be fluidly and removeably coupled to the first end of the ink delivery system. The vacuum source may include a syringe. The fluid module may include a replaceable ink supply cartridge filled with fluid for flushing the ink delivery system.

The printing device may further include a replaceable ink supply container having a first coupler configured to be fluidly and removeably coupled to the first end of the ink delivery system and a second coupler configured to be fluidly and removeably coupled to the fluid module.

An embodiment of a method for flushing a printing composition from an ink delivery system of a printing device includes the steps of fluidly and removeably coupling a fluid module to a first end of the ink delivery system of the printing device and fluidly and removeably coupling a vacuum source to a second end of the ink delivery system of the printing device. The method additionally includes the step of manually drawing a vacuum at the second end of the ink delivery system of the printing device thereby drawing fluid out of the fluid module and into the first end of the ink delivery system, and further thereby drawing ink and the fluid out of the second end of the ink delivery system.

The above-described embodiment of the method of the present invention may include the following additional steps, as discussed below. The method may further include the steps of removing the fluid module from the first end of the ink delivery system, and fluidly and removeably coupling the first end of the ink delivery system to a source of air. This aspect of the method additionally includes the step of manually drawing a second vacuum at the second end of the ink delivery system thereby allowing air to enter the first end of the ink delivery system and thereby drawing any remaining ink and fluid from the second end of the ink delivery system.

The method may further include the steps of disconnecting the first end of the ink delivery system from the source of air, fluidly connecting the first end of the ink delivery system to a supply of ink, and manually drawing a third vacuum at the second end of the ink delivery system to draw ink into the first end of the ink delivery system.

Other objects, advantages, and novel features of the present invention will become apparent from the following detailed description of the invention when considered in conjunction with the accompanying drawings.

DETAILED DESCRIPTION OF THE DRAWINGS

Figure 1:
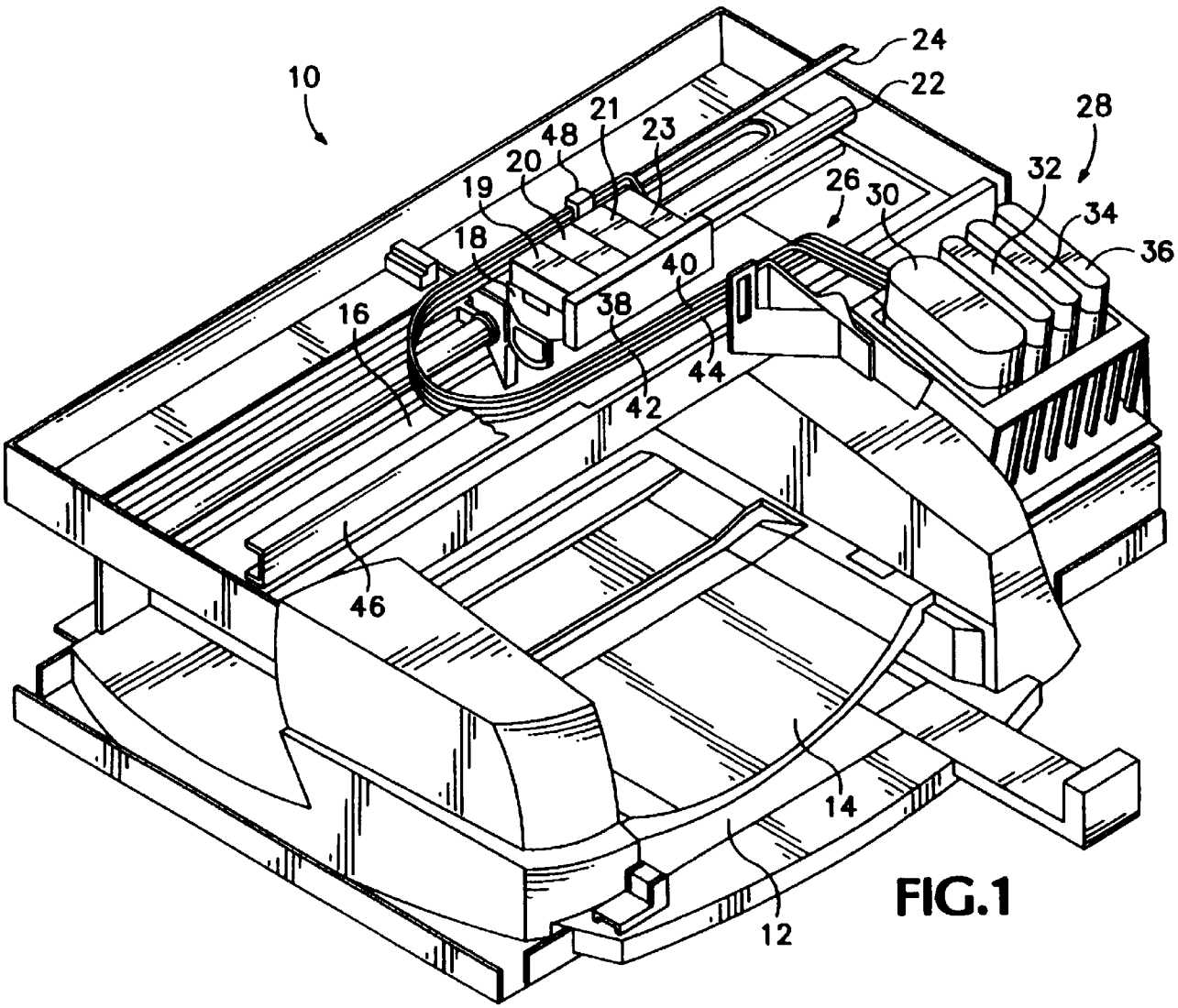
FIG. 1 is a perspective view of a printing device in which the present invention may be used to flush an ink delivery system of the printing device so that different inks may be used therein.

FIG. 1 is a perspective view of an exemplary embodiment of a printing device 10, here shown as an inkjet printer, in which the present invention may be used. Printer 10 includes an input print media tray 12 for holding an input supply of print media such as paper, transparencies, etc. When a printing operation is initiated, a sheet of print media is fed into printing device 10 using a print media sheet feeder, and then brought around in a U-direction to travel in the opposite direction toward output print media tray 14. The sheet of print media is stopped in a print zone 16, and a scanning carriage 18, containing one or more print cartridges 19, 20, 21, and 23 is then scanned across the sheet for printing a swath of ink thereon. After a single scan or multiple scans, the sheet of print media is then incrementally shifted using a motor and feed rollers (not shown in FIG. 1) to a next position within print zone 16, and carriage 18 again scans across the sheet of print media for printing a next swath of ink. When printing on the sheet of print media is complete, the sheet is forwarded to a position above output print media tray 14, held in that position to ensure the ink is dry, and then released into tray 14. A scanning mechanism for carriage 18 includes a slide rod 22, along which carriage 18 slides, and a coded strip 24 which is optically detected by a photo detector (not shown) on carriage 18 for precisely positioning carriage 18. A stepper motor (not shown in FIG. 1) is connected to carriage 18 using a drive belt and pulley arrangement and used for transporting carriage 18 across print zone 16.

Printing device 10 includes a printing composition delivery system 26, here shown as an ink delivery system, for delivering ink to a printing mechanism that includes print cartridges 19, 20, 21, and 23. Ink from ink delivery system 26 is supplied by an ink supply station 28 that includes replaceable ink supply cartridges 30, 32, 34, and 36. For color ink jet printers, there are typically separate replaceable ink supply cartridges for black ink, yellow ink, magenta ink, and cyan ink. Since black ink tends to be depleted most rapidly, black ink supply 30 has a larger capacity than the capacities of the other ink supplies 32, 34, and 36.

A set of four ink supply tubes 38, 40, 42, and 44 carry ink from the four ink supply cartridges 30, 32, 34, and 36 to the four print cartridges 19, 20, 21, and 23. Tubes 38, 40, 42, and 44 are routed from ink supply station 28 to cartridges 19, 20, 21, and 23 on carriage 18 along C-shaped channel guide 46, only a portion of which is shown in FIG. 1, which is open along a side facing print zone 16. A clamp (not shown) located near ink supply station 28 secures tubes 38, 40, 42, and 44 to guide 46, yet permits the tubes to move out of guide 46 as needed to follow scanning carriage 18 along slide rod 22. Tubes 38, 40, 42 and 44 may be secured to scanning carriage 18 by a stress relief clamp 48.

Often during printing, it is desirable to change to a different type of ink for a particular printing application. For example, a user may want to switch one or more of the colors in cartridges 30, 32, 34, and 36. This cannot simply be done by removing one of these cartridges and replacing it with a different color ink because the replacement cartridge can become contaminated with ink remaining in ink delivery system 26 from the previous replaceable ink supply cartridge. In addition, ink from the previous replaceable ink supply cartridge remaining in the tubes will first be printed on the sheet of print media before the different ink from the new replaceable ink supply cartridge, causing printing device 10 to improperly print the desired text and/or image. Further, a new print cartridge for the different ink can be contaminated by the previous ink remaining in ink delivery system 26. A device and method for flushing ink delivery system 26 is therefore desirable to achieve optimal performance of printing device 10 when changing one or more of the inks used by printing device 10. The present invention is directed at providing such a device and method.

Figure 2:
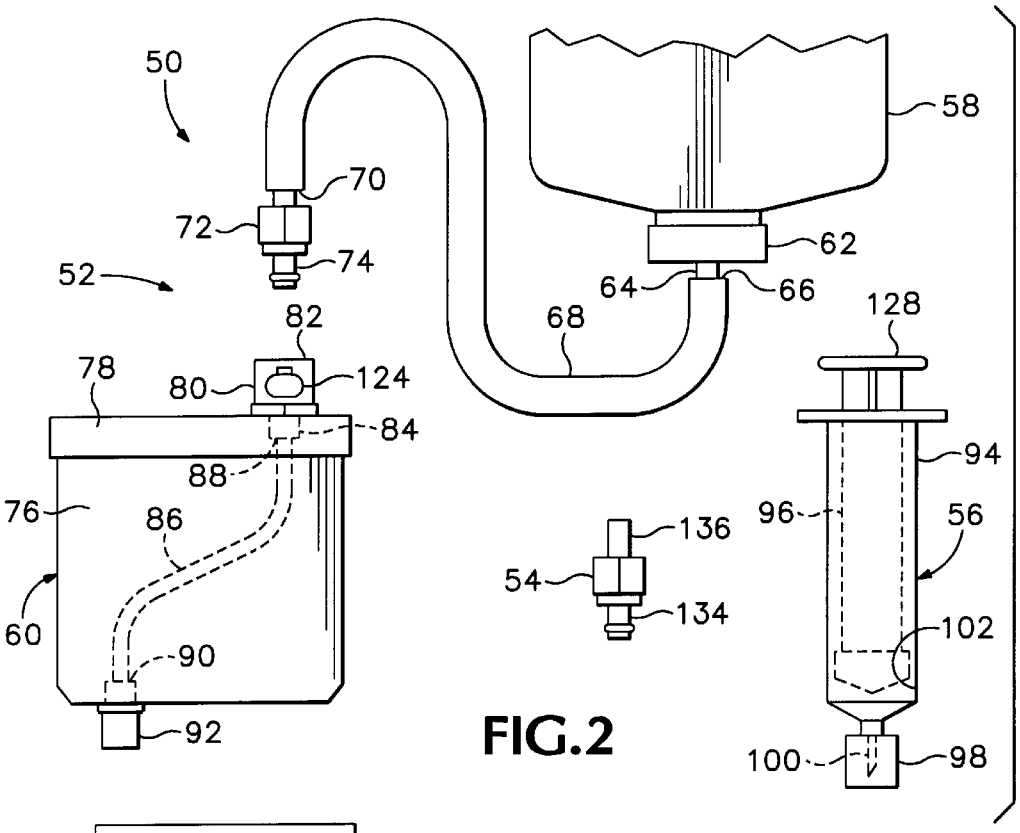
FIG. 2 is a diagrammatic view of an embodiment of a kit in accordance with the present invention for flushing an ink delivery system of the printing device of FIG. 1.

An embodiment of a kit 50 in accordance with the present invention for flushing ink from ink delivery system 26 of printing device 10 is shown in FIG. 2. Kit 50 may be used to flush ink from ink delivery system 26 when one or more inks contained in replaceable ink cartridges 30, 32, 34 and 36 are replaced, as more fully discussed below. Kit 50 includes a fluid module 52, a coupler 54, and a vacuum source 56. Fluid module 52 includes a bottle 58 that contains a flushing fluid, such as de-ionized water, and a modified replaceable ink supply cartridge 60. Coupler 54 is a male quick disconnect fitting that may be purchased from Cole-Parmer under the part no. E-06364-38.

Bottle 58 includes a manually actuable cap 62 that may be threadably secured to bottle 58 by turning cap 62 in a counterclockwise direction and removed from bottle 58 for filling with flushing fluid by manually turning cap 62 in a clockwise direction. Cap 62 includes a fitting 64 that fluidly connects with the flushing fluid contained in bottle 58. A first end 66 of a flexible tube 68 is fluidly connected to fitting 64 and a second end 70 of flexible tube 68 is fluidly connected to a male quick disconnect fitting 72. Quick disconnect fitting 72 may be purchased from Cole-Parmer under the part no. E-06364-38. As can be seen in FIG. 2, quick disconnect fitting 72 includes a male member 74 for removeably and fluidly connecting to a corresponding female member, as more fully discussed below.

Modified replaceable ink supply cartridge 60 is structurally similar to replaceable ink supply cartridges 30, 32, 34 and 36. Modified replaceable ink supply cartridge 60 includes a reservoir body 76 and a cap 78 which is secured thereto. A coupler 80 is secured to cap 78 and includes a female member 82 for removeably and fluidly connecting with male member 74 of quick disconnect fitting 72. Coupler 80 is a female quick disconnect fitting that may be purchased from Cole-Parmer under the part no. E-06364-09. A fitting 84 fluidly connects with a tube 86 inside reservoir body 76 at a first end 88 of tube 86. A second end 90 of tube 86 fluidly connects to septum coupler 92. Septum coupler 92 fluidly connects to ink delivery system 26 at ink supply station 28, as more fully discussed below in connection with FIG. 4.

As discussed above, kit 50 also includes coupler 54. In the embodiment of kit 50 shown in FIG. 2, coupler 54 is the same as quick disconnect fitting 72 and may be purchased under the same part number from the same source. The function and purpose of coupler 54 will be discussed more fully below in connection with FIG. 5.

Vacuum source 56 of kit 50 includes a syringe 94 which may be purchased from General Tool & Supply under the part no. KAHM10LLASSM. Syringe 94 includes a plunger 96 that may be manually actuated to draw a vacuum, as more fully discussed below. Syringe 94 also includes a coupler 98 and needle 100 for fluidly and removeably coupling ink delivery system 26 to interior cavity 102 of syringe 94, as more fully discussed below.

A method of using kit 50 in accordance with the present invention is discussed in detail below in connection with FIGS. 3–6. Replacement of ink in replaceable ink supply cartridge 32 and corresponding print cartridge 20 are illustrated. However, it is to be understood that the illustrated sequence shown in FIGS. 3–6 may be used for replaceable ink supply cartridges 30, 34, and 36 and print cartridges 19, 21, and 23 as well.

Figure 3:
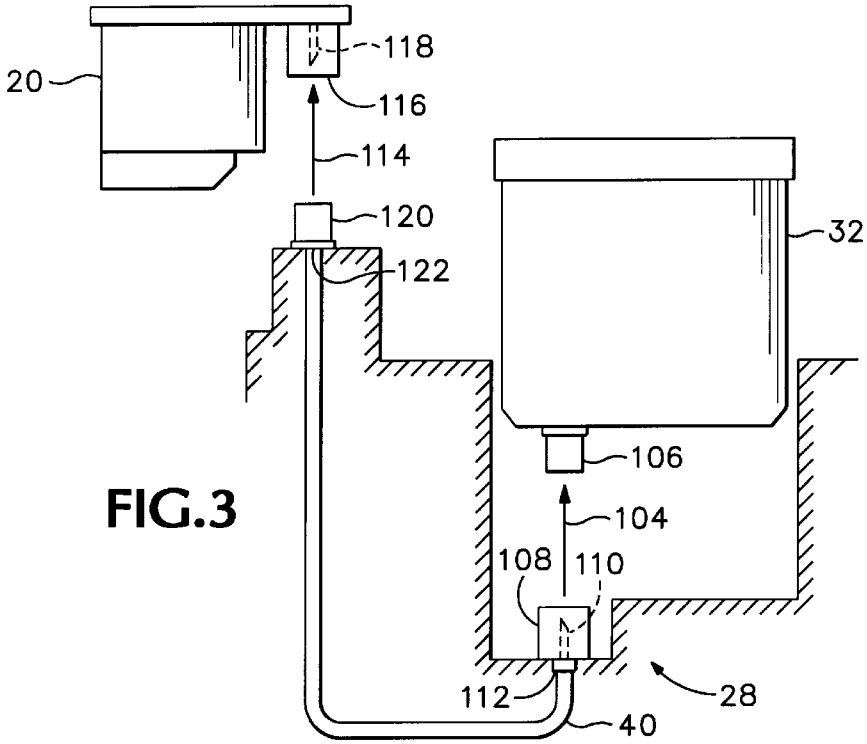
FIG. 3 is a diagrammatic view of the removal of a replaceable ink supply cartridge and a print cartridge from the ink delivery system of the printing device of FIG. 1.

A first step of removing replaceable ink supply cartridge 32 from ink supply station 28 and print cartridge 20 from carriage 18 is diagrammatically shown in FIG. 3. This is accomplished by manually pulling cartridge 32 in a direction generally indicated by arrow 104 in FIG. 3 so that septum coupler 106 of cartridge 32 is decoupled and removed from coupler 108 of supply station 28. As can be seen in FIG. 3, coupler 108 includes a needle 110 that is capable of being fluidly and removeably coupled to septum coupler 106 of cartridge 32. Needle 110 is fluidly connected to first end 112 of tube 40. Although not shown, it is to be understood that ink supply station 28 includes couplers and needles for cartridges 30, 34, and 36 and tubes 38, 42, and 44 as well.

Print cartridge 20 is manually removed from scanning carriage 18 by manually pulling cartridge 20 in a direction generally indicated by arrow 114 in FIG. 3 to remove coupler 116 and needle 118 of cartridge 20 from septum coupler 120 on carriage 18. Septum coupler 116 is fluidly connected to second end 122 of tube 40. Although not shown, it is to be understood that carriage 18 includes couplers corresponding to coupler 116 for cartridges 19, 21, and 23 and tubes 38, 42, and 44 as well.

Figure 4:
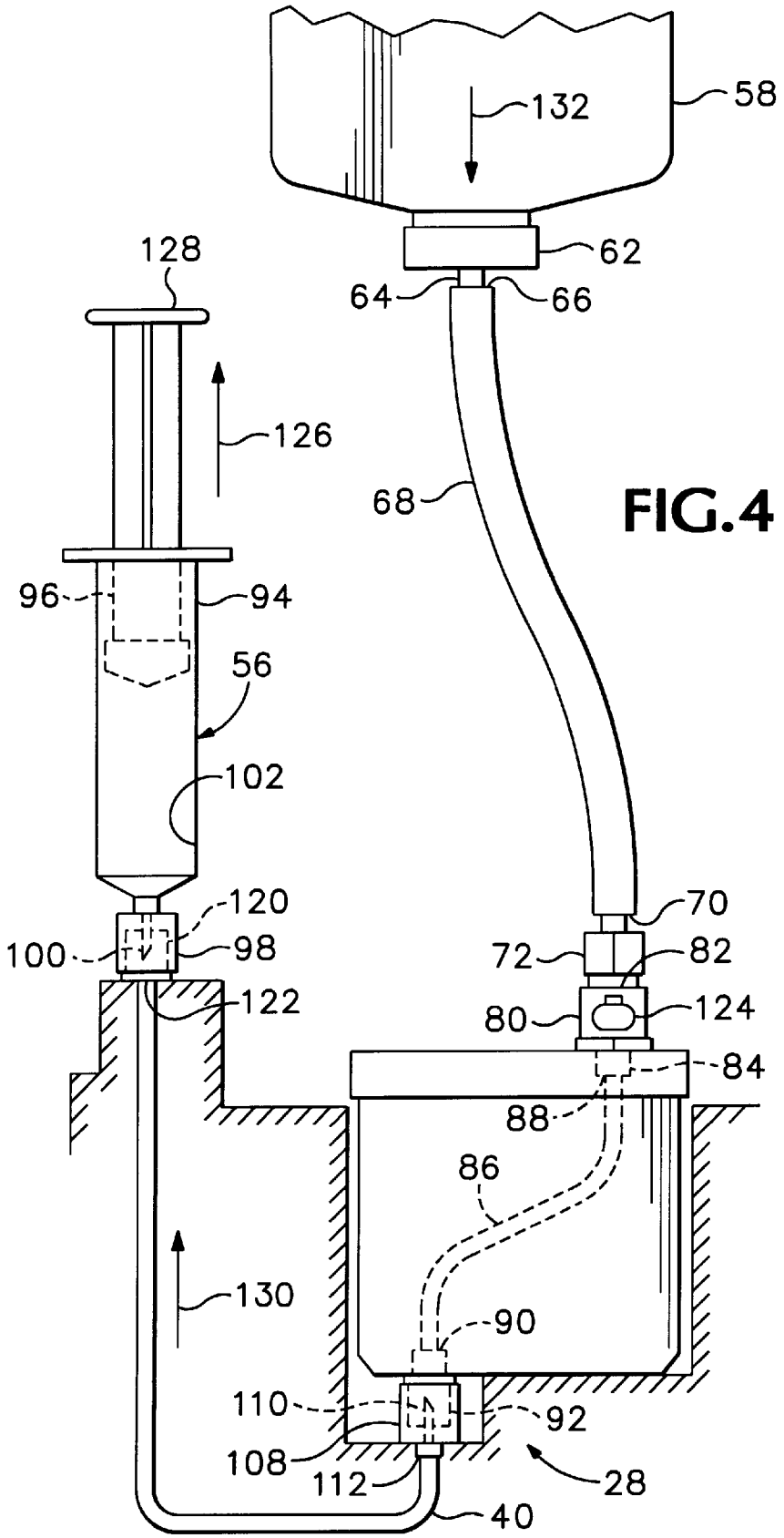
FIG. 4 is a diagrammatic view of the use of the kit of FIG. 2 to flush the ink delivery system of the printing device of FIG. 1 in accordance with a method of the present invention.

Next, ink delivery system 26 is flushed with a flushing fluid, as diagrammatically shown in FIG. 4. Modified replaceable ink supply cartridge 60 is inserted into ink supply station 28 by fluidly and removeably coupling septum coupler 92 of cartridge 60 to coupler 108 by inserting needle 110 into septum coupler 92. Next, bottle 58 is fluidly and removeably coupled to modified replaceable ink supply cartridge 60 by disposing male member 74 of quick disconnect fitting 72 in female member 82 of coupler 80. Coupler 80 includes a check valve 124 that is normally closed so that flushing fluid from bottle 58 cannot enter cartridge 60 unless valve 124 is unseated, which occurs when male quick disconnect fitting 72 is connected to female quick disconnect fitting 80, as described above.

Next, vacuum source 56 is fluidly and removeably coupled to tube 40 of ink delivery system 26 by disposing needle 110 in septum coupler 120 so that coupler 98 surrounds coupler 120. A vacuum in interior cavity 102 of syringe 94 is created by manually actuating plunger 96 in a generally upward direction as indicated by arrow 126 in FIG. 4. This vacuum draws ink out of tube 40 as generally indicated by arrow 130, and also draws flushing fluid out of bottle 58 and into tube 40 via tubes 68 and 86, as generally indicated by arrow 132. The ink in tube 40 leaves and enters interior cavity 102 of syringe 94. The volume of interior cavity 102 may be chosen to be of sufficient size so that all of the ink in tube 40 is drawn out and a portion of flushing fluid in bottle 58 is also drawn into interior cavity 102 after passing through tube 40. Alternatively, if cavity 102 of syringe 94 fills completely, it may be removed, emptied, and subsequently fluidly and removeably coupled to septum coupler 120 to further draw ink out of and flushing fluid into tube 40, as illustrated in FIG. 4.

Figures 5, 6:
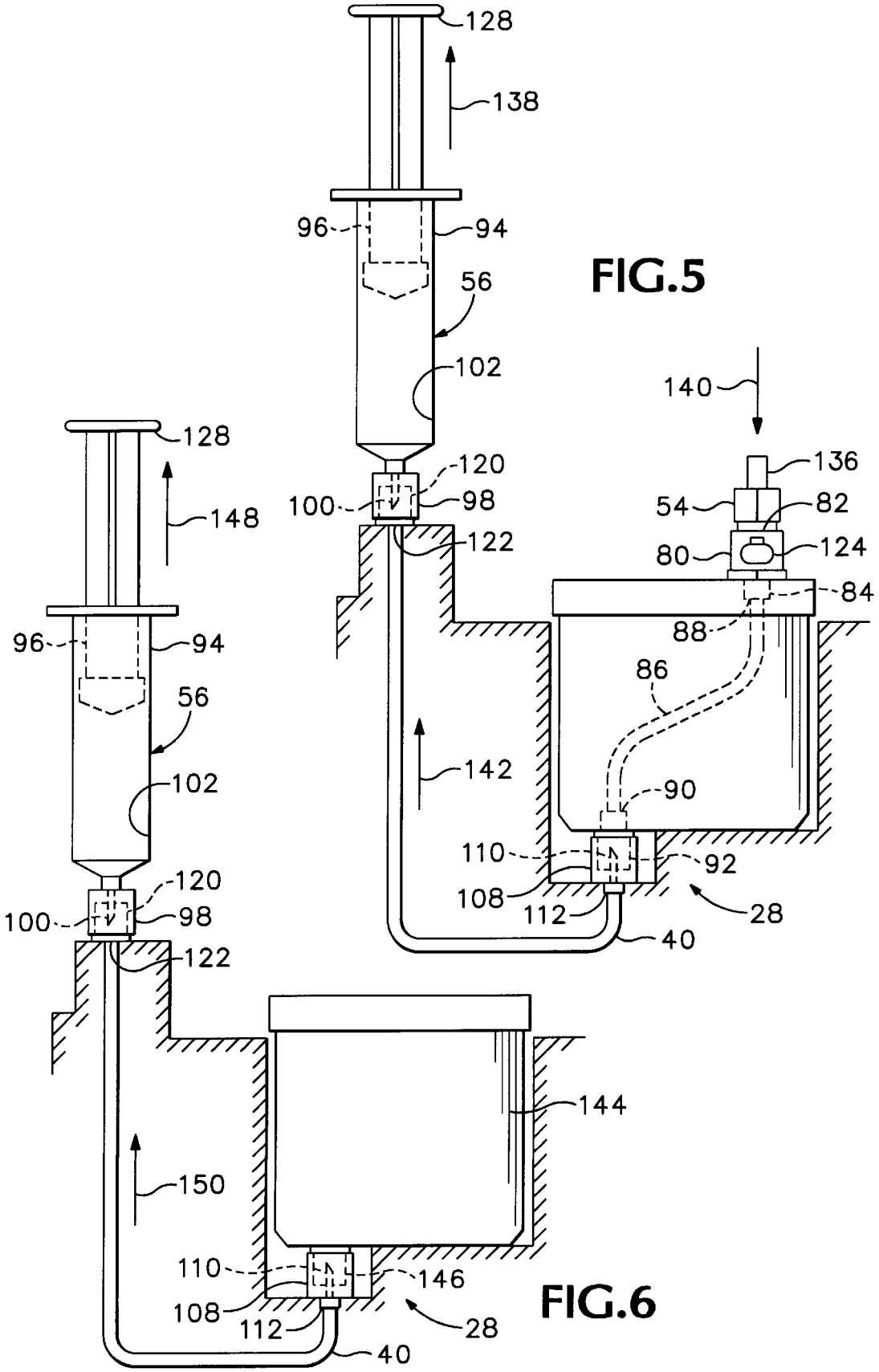
FIG. 5 is a diagrammatic view of the use of the kit of FIG. 2 to further flush the ink delivery system of the printing device of FIG. 1 in accordance with a method of the present invention.
FIG. 6 is a diagrammatic view of a portion of the kit of FIG. 2 and a new replaceable ink supply cartridge with the kit being used to remove any remaining flushing fluid or air from the ink delivery system of the printing device of FIG. 1 and to also help prime the ink delivery system of the printing device of FIG. 1, both of which are in accordance with a method of the present invention.

After tube 40 of ink delivery system 26 has been flushed of ink, the flushing fluid now in tube 40 must be removed. This step of the method in accordance with the present invention for kit 50 is illustrated in FIG. 5. After bottle 58 has been decoupled by removing male member 74 from female member 82 of coupler 80, male member 134 of coupler 54 is inserted into female member 82 of coupler 80 which unseats check valve 124. Coupler 54 includes a stem 136 that is fluidly connected to ambient air. Plunger 96 of syringe 94 is then manually pulled upward in a direction generally indicated by arrow 138 to create a further vacuum in interior cavity 102 thereof. This vacuum draws ambient air into stem 136 through tube 86 into tube 40, as generally indicated by arrow 140, and also draws ink out of and air into tube 40, as generally indicated by arrow 142. Plunger 96 should be moved sufficiently upward to draw the flushing fluid completely out of tube 40. If cavity 102 of syringe 94 fills completely, it may be removed, emptied, and subsequently fluidly and removeably recoupled to septum coupler 120 to further draw flushing fluid out of and air into tube 40, as illustrated in FIG. 5.

Next, a new replaceable ink supply cartridge 144 containing a different ink than replaceable ink supply cartridge 32 is inserted into ink supply station 28 and fluidly and removeably coupled to tube 40 by disposing needle 110 in septum coupler 146 of cartridge 144 after modified replaceable ink supply cartridge 60 is removed, as diagrammatically shown in FIG. 6. Any remaining flushing fluid or air in tube 40 may be removed by manually actuating plunger 96 in an upward direction, as generally indicated by arrow 148 in FIG. 6 which causes any such fluid or air to travel out of second end 122 of tube 40 and into interior cavity 102 of syringe 94, as generally indicated by arrow 150. This operation also helps prime tube 40 of ink delivery system 26 by drawing printing composition from replaceable ink supply cartridge 144 into tube 40.

Although not shown, the next step is to remove syringe 94 of vacuum source 56 from septum coupler 120 by removing needle 110 from septum coupler 120. Finally, a new print cartridge (not shown) which replaces print cartridge 20 is fluidly and removeably coupled to tube 40 of ink delivery system 26 by disposing a needle (not shown) of this cartridge into septum coupler 120.

Although the invention has been described and illustrated in detail, it is to be clearly understood that the same is intended by way of illustration and example only, and is not to be taken by way of limitation. For example, in an alternative embodiment of kit 50, bottle 58 is removed altogether and only modified replaceable ink supply cartridge 60 is used. This cartridge is filled with a sufficient quantity of flushing fluid, such as de-ionized water. As another example, an embodiment of a different kit in accordance with the present invention does not use modified replaceable ink supply cartridge 60, but only uses bottle 58 which contains a different coupler than quick disconnect fitting 72 that allows direct fluid and removeable coupling to coupler 108 of ink supply station 28, such as a septum coupler. As a further example, a bellows device may be used as a vacuum source instead of syringe 94. As yet a further example, vacuum source 56 may be fluidly and removeably coupled at first end 112 of tube 40 of ink delivery system 26 at ink supply station 28 or to a modified a replaceable ink supply 60, and the source of flushing fluid fluidly and removeably coupled to septum coupler 120 on scanning carriage 18 by, for example, a needle. As still yet a further example, the present invention may be used with large-format inkjet printers, such as plotters. The spirit and scope of the invention are to be limited only by the terms of the following claims.

What is claimed is:

1. A kit for flushing printing composition from an ink delivery system of a printing device, the ink delivery system including a first end and a second end, and the ink delivery system being configured to deliver ink from an ink supply cartridge fluidly and removeably coupled to the first end of the ink delivery system to a print cartridge fluidly and removeably coupled to the second end of the ink delivery system, the kit comprising:

a fluid module, the fluid module being configured to store a quantity of fluid for flushing the ink delivery system;

a coupler fluidly connectable to the fluid module and configured to be fluidly and removeably coupled to the first end of the ink delivery system; and a vacuum source configured to be fluidly and removeably coupled to the second end of the ink delivery system subsequent to decoupling of the print cartridge from the second end of the ink delivery system, and further configured to be manually actuable to create a vacuum that draws the fluid from the fluid module into the ink delivery system thereby flushing the ink delivery system.

2. The kit of claim 1, wherein the coupler includes a disconnect fitting configured to be fluidly and removeably coupled to the first end of the ink delivery system.

3. The kit of claim 1, wherein the vacuum source includes a syringe.

4. The kit of claim 1, wherein the fluid module includes a replaceable ink supply cartridge filled with fluid for flushing the ink delivery system.

5. The kit of claim 1, further comprising a replaceable ink supply container including a first coupler configured to be fluidly and removeably coupled to the first end of the ink delivery system and a second coupler configured to be fluidly and removeably coupled to the fluid module.

6. A kit for flushing an ink delivery system of a printing device, the ink delivery system including a first end and a second end, and the ink delivery system being configured to deliver ink from an ink supply cartridge fluidly and removeably coupled to the first end of the ink delivery system to a print cartridge fluidly and removeably coupled to the second end of the ink delivery system, the kit comprising:

means for storing a quality of fluid used to flush the ink delivery system;

means for fluidly and removeably coupling the means for storing to the first end of the ink delivery system; and means configured to be fluidly and removeably coupled to the second end of the ink delivery system subsequent to decoupling of the print cartridge from the second end of the ink delivery system for manually drawing a vacuum at the second end of the ink delivery system to cause the fluid in the means for storing to travel through the ink delivery system and exit the ink delivery system thereby flushing the ink delivery system.

7. The kit of claim 6, wherein the means for storing includes one of a fluid module and a replaceable ink supply container filled with fluid used to flush the ink delivery system.

8. The kit of claim 6, wherein the means for fluidly connecting includes a disconnect fitting configured to be fluidly and removeably coupled to the first end of the ink delivery system.

9. The kit of claim 6 wherein the means for manually drawing a vacuum includes a syringe.

10. A printing device, comprising:

an ink delivery system including a first end and a second end;

a printing mechanism fluidly and removeably coupled to the second end of the ink delivery system for printing an image;

a fluid module, the fluid module being configured to store a quantity of fluid for flushing the ink delivery system;

a coupler fluidly connectable to the fluid module and configured to be fluidly and removeably coupled to the first end of the ink delivery system; and a vacuum source configured to be fluidly and removeably coupled to the second end of the ink delivery system subsequent to decoupling of the printing mechanism from the second end of the ink delivery system, and further configured to be manually actuable to create a vacuum that draws the fluid from the fluid module into the ink delivery system thereby flushing the ink delivery system.

11. The printing device of claim 10, wherein the coupler includes a disconnect fitting configured to be fluidly and removeably coupled to the first end of the ink delivery system.

12. The printing device of claim 10, wherein the vacuum source includes a syringe.

13. The printing device of claim 10, wherein the fluid module includes a replaceable ink supply cartridge filled with fluid for flushing the ink delivery system.

14. The printing device of claim 10, further comprising a replaceable ink supply container including a first coupler configured to be fluidly and removeably coupled to the first end of the ink delivery system and a second coupler configured to be fluidly and removeably coupled to the fluid module.

15. A method for flushing a printing composition from an ink delivery system of a printing device, the ink delivery system including a first end and a second end, and the ink delivery system being configured to deliver ink from an ink supply cartridge fluidly and removeably coupled to the first end of the ink delivery system to a print cartridge fluidly and removeably coupled to the second end of the ink delivery system, the method comprising the steps of:

decoupling the print cartridge from the second end of the ink delivery system;

fluidly and removeably coupling a fluid module to the first end of the ink delivery system of the printing device;

fluidly and removeably coupling a vacuum source to the second end of the ink delivery system of the printing device; and manually drawing a vacuum at the second end of the ink delivery system of the printing device thereby drawing fluid out of the fluid module and into the first end of the ink delivery system and further thereby drawing ink and the fluid out of the second end of the ink delivery system.

16. The method of claim 15, further comprising the steps of:

removing the fluid module from the first end of the ink delivery system;

fluidly and removeably coupling the first end of the ink delivery system to a source of air; and manually drawing a second vacuum at the second end of the ink delivery system thereby allowing air to enter the first end of the ink delivery system and thereby drawing any remaining ink and fluid from the second end of the ink delivery system.

17. The method of claim 16, further comprising the steps of:

disconnecting the first end of the ink delivery system from the source of air;

fluidly connecting the first end of the ink delivery system to a supply of ink; and manually drawing a third vacuum at the second end of the ink delivery system to draw ink into the first end of the ink delivery system.

* * * * *